US008608027B2

(12) United States Patent
Myoujin et al.

(10) Patent No.: US 8,608,027 B2
(45) Date of Patent: Dec. 17, 2013

(54) SPRAY APPARATUS

(75) Inventors: Hiroyasu Myoujin, Shinjuku-ku (JP); Aya Januma, Shinjuku-ku (JP); Satoshi Higuchi, Shinjuku-ku (JP)

(73) Assignee: S.T. Corporation, Tokyo (JP)

( * ) Notice: Subject to any disclaimer, the term of this patent is extended or adjusted under 35 U.S.C. 154(b) by 367 days.

(21) Appl. No.: 12/988,982

(22) PCT Filed: Jan. 27, 2009

(86) PCT No.: PCT/JP2009/051257

§ 371 (c)(1), (2), (4) Date: Oct. 21, 2010

(87) PCT Pub. No.: WO2009/130927

PCT Pub. Date: Oct. 29, 2009

(65) Prior Publication Data

US 2011/0036932 A1 Feb. 17, 2011

(30) Foreign Application Priority Data

Apr. 23, 2008 (JP) ..... 2008-111935

(51) Int. Cl.

| | |
|---|---|
| ***B67D 1/00*** | (2006.01) |
| ***G04C 23/42*** | (2006.01) |
| ***G05D 7/00*** | (2006.01) |

(52) U.S. Cl.

USPC ..... 222/52; 222/649

(58) Field of Classification Search

USPC ..... 222/52, 61, 63, 23, 41, 638, 649, 642; 239/569

See application file for complete search history.

(56) References Cited

U.S. PATENT DOCUMENTS

| | | | | |
|---|---|---|---|---|
| 4,755,653 | A * | 7/1988 | Townsend et al. | 392/365 |
| 6,679,436 | B1 * | 1/2004 | Onishi et al. | 239/101 |
| 6,974,091 | B2 * | 12/2005 | McLisky | 239/302 |
| 2002/0020756 | A1 * | 2/2002 | Yahav | 239/11 |
| 2006/0018640 | A1 * | 1/2006 | Hinesley | 392/420 |
| 2006/0076366 | A1 * | 4/2006 | Furner et al. | 222/402.13 |
| 2006/0243762 | A1 * | 11/2006 | Sassoon | 222/649 |

FOREIGN PATENT DOCUMENTS

| | | | |
|---|---|---|---|
| JP | 59-222246 | | 12/1984 |
| JP | 4-106672 | | 9/1992 |
| JP | 9-065811 | | 3/1997 |
| JP | 2003-135554 | | 5/2003 |
| JP | 2003135554 | A * | 5/2003 |
| JP | 2004-298780 | | 10/2004 |
| JP | 2004-298781 | | 10/2004 |

(Continued)

OTHER PUBLICATIONS

Machine translation of JP 2003135554.*

(Continued)

*Primary Examiner* — Paul R Durand
*Assistant Examiner* — Jeremy W Carroll
(74) *Attorney, Agent, or Firm* — Jordan and Hamburg LLP

(57) ABSTRACT

A spray apparatus is provided, which can prevent a disadvantage which can occur when falling down. In a normal state where a bottom surface of a leg part of the apparatus main body is in contact with a mounting surface, a stand switch is on, and therefore, a shift to a spray process for spraying the agent is permitted, whereas at a time of the stand switch being off when the apparatus main body falls down, a shift to the spray process is avoided.

1 Claim, 6 Drawing Sheets

(56) References Cited

FOREIGN PATENT DOCUMENTS

| | | | |
|---|---|---|---|
| JP | 2004-298782 | | 10/2004 |
| JP | 2004298780 | A * | 10/2004 |
| JP | 2008-043251 | | 2/2008 |
| JP | 2008043251 | A * | 2/2008 |

OTHER PUBLICATIONS

Machine translation of JP 2004298780.*
Machine translation of JP 2008043251.*

* cited by examiner

SPRAY APPARATUS

The present invention relates to a spray apparatus which sprays an agent from a spray can.

BACKRGOUND OF THE INVENTION

Conventionally, spray apparatuses which automatically spray agents from the spray cans set in the cases have been known (for example, Patent Document 1 to Patent Document 3).

These spray apparatuses are configured to spray the agents in the spray cans by operating the nozzles of the spray cans, which are set therein, every predetermined time.

Patent Document 1: Japanese Patent Laid-Open No. 2004-298780

Patent Document 2: Japanese Patent Laid-Open No. 2004-298781

Patent Document 3: Japanese Patent Laid-Open No. 2004-298782

SUMMARY OF THE INVENTION

However, in such conventional spray apparatuses, the spray apparatuses sometimes fall down, and in the state where they fall down and are not in the proper positions, the nozzles face in unintended directions.

If a predetermined time elapses in this state, agents are sprayed from the aforementioned nozzles, and the problem of, for example, contaminating a wall surface with the agents can arise.

The present invention is made in view of such a conventional problem, and has an object to provide a spray apparatus capable of preventing the problem that can arise during spraying.

In order to solve the aforementioned problem, in a spray apparatus of the present invention, a spray apparatus including spray means which sprays an agent from a spray can set in an apparatus main body includes detecting means which detects that the apparatus main body is not installed in a proper position, and spray process avoiding means which avoids a spray process of the agent by the spray means when the detecting means detects that the apparatus main body is not installed in the proper position.

More specifically, when the apparatus main body displaces from the aforementioned proper position while the apparatus main body in which the spray can is set is installed in a proper position and used, it is detected that the apparatus main body is not installed in the aforementioned proper position. In that case, the spray process of spraying the agent from the aforementioned spray can is avoided.

Thereby, spray of the agent in the state in which the apparatus main body is not in the aforementioned proper position is prevented, and spray of the agent in an unintended direction is prevented.

Further, according to a second aspect of the present invention, a spray apparatus including spray means which repeatedly sprays an agent from a spray can set in an apparatus main body includes detecting means which detects that the apparatus main body is not installed in a proper position, and spray process avoiding means which avoids spray process of the agent by the spray means when the detecting means detects that the apparatus main body is not installed in the proper position.

More specifically, when the apparatus main body displaces from the aforementioned proper position while the apparatus main body in which the spray can is set is installed in the proper position and used, it is detected that the apparatus main body is not installed in the aforementioned proper position. In that case, the spray process of spraying an agent from the aforementioned spray can is avoided.

Thereby, spray of the agent in the state in which the apparatus main body is not in the aforementioned proper position is prevented, and spray of the agent in an unintended direction at the time of spraying is prevented.

Further, in a spray apparatus according to the third aspect of the present invention, the spray apparatus further includes a switch which is operated when one surface separates from an opposed surface to which the one surface of the apparatus main body is opposed in a state in which the apparatus main body is disposed in the proper position, wherein the detecting means detects that the apparatus main body is not installed in the proper position from an operation state of the switch.

More specifically, the aforementioned apparatus main body is provided with the switch which is operated when the one surface separates from the opposed surface to which the one surface is opposed, and the aforementioned switch is operated when the apparatus main body displaces from the aforementioned proper position and the aforementioned one surface separates from the aforementioned opposed surface.

Therefore, by detecting the change of the operation state of the switch, it is detected that the apparatus main body is not in the aforementioned proper position.

Further, in a spray apparatus according to a fourth aspect of the present invention, the spray apparatus including spray means, which sprays an agent from a spray can set in an apparatus main body, includes fall detecting means which detects that the apparatus main body falls down, and spray process avoiding means which avoids a spray process of the agent by the spray means when the fall detecting means detects a fall.

More specifically, when the apparatus main body falls down while the apparatus main body in which the spray can is set is mounted on the mounting surface and used, it is detected that the apparatus main body falls down. In that case, the spray process of spraying the agent from the aforementioned spray can is avoided.

Thereby, spray of the agent in the state in which the apparatus main body falls down is prevented, and spray of the agent in an unintended direction is prevented.

Furthermore, in a spray apparatus according to a fifth aspect of the present invention, the spray apparatus farther includes a bottom surface switch which is operated when a bottom surface of the apparatus main body separates from a mounting surface, wherein the fall detecting means detects that the apparatus main body falls down from an operation state of the bottom surface switch.

More specifically, the aforementioned apparatus main body is provided with the bottom surface switch which operates when the apparatus main body separates from the mounting surface, and when the apparatus main body falls down, and the bottom surface of the apparatus main body separates from the mounting surface, the aforementioned bottom surface switch is operated.

Therefore, by detecting the change of the operation state of the bottom surface switch, it is detected that the apparatus main body falls down.

In addition, in a spray apparatus according to a sixth aspect of the present invention, the spray apparatus further includes arbitrary spray means which executes the spray process by the spray means when a push-button type spray switch provided in a top part of the apparatus main body is operated, wherein the apparatus main body is formed in a laterally oriented shape in plane view, and the bottom surface switch and the spray switch are disposed at one side with a center in a lateral direction of the apparatus main body as a boundary.

More specifically, the top part of the aforementioned apparatus main body is provided with the push-button type spray switch, and by pressing down and operating the spray switch, the aforementioned spray process is executed and the aforementioned agent can be sprayed.

In this case, the aforementioned apparatus main body is formed into a laterally oriented shape in plane view, and the aforementioned bottom surface switch and the aforementioned spray switch are disposed at one side with the center in the lateral direction of the apparatus main body as the boundary.

Therefore, in the state in which the spray switch provided in the top part of the aforementioned apparatus main body is pressed down and operated, an unexpected lift is prevented at the aforementioned one side of the aforementioned bottom surface provided with the aforementioned bottom surface switch.

In the spray apparatus of the first aspect of the present invention, if the apparatus main body in which the spray can is set is not disposed in the proper position, spray of the agent from the aforementioned spray can is able to be prevented.

Therefore, even if the spray apparatus displaces from the proper positions, spray of the agent in an unintended direction can be prevented as compared with the conventional spray apparatus which sprays an agent when the spray requirements are fulfilled.

Thereby, even if the spray direction from the apparatus main body which displaces from the proper position is toward the wall surface, the problem of the agent being sprayed to the wall surface and contaminating the wall surface, which can occur when the apparatus main body displaces from the proper position, can be reliably prevented.

Spray of the agent also can be prevented when the aforementioned apparatus main body is moved, and therefore, the problem caused by spray of the agent to legs and hands, clothing and the like can be reliably prevented.

Further, in the spray apparatus of the second aspect of the present invention, if the apparatus main body in which the spray can is set is not disposed in the proper position, spray of the agent from the aforementioned spray can is able to be prevented.

Therefore, even if the spray apparatus displaces from the proper positions, repeated spray of the agent in an unintended direction can be prevented as compared with the conventional spray apparatus which repeatedly sprays an agent.

Thereby, even if the spray direction from the apparatus main body which displaces from the proper position is toward the wall surface, the problem of the agent being sprayed to the wall surface and contaminating the wall surface, which can occur when the apparatus main body displaces from the proper position, can be reliably prevented.

Spray of the agent also can be prevented when the aforementioned apparatus main body is moved, and therefore, the problem caused by spray of the agent to legs and hands, clothing and the like can be reliably prevented.

Further, in the spray apparatus of to third aspect of the present invention, it can be detected that the apparatus main body displaces from the proper position by the switch provided in the apparatus main body.

Therefore, as compared with the case of using an expensive position detecting sensor or the like which detects the displacement of the apparatus main body, the cost can be reduced, and the configuration can be simplified.

Further, in the spray apparatus of the fourth aspect of the present invention, when the apparatus main body in which the spray can is set falls down, spray of the agent from the aforementioned spray can is able to be prevented.

Therefore, even if the spray apparatus falls down, spray of the agent in an unintended direction can be prevented as compared with the conventional spray apparatus which sprays an agent when the spray requirements are fulfilled.

Thereby, even if the spray direction is toward the wall surface, the problem of the agent being sprayed to the wall surface and contaminating the wall surface, which can occur when the apparatus main body falls down, can be reliably prevented.

Spray of the agent also can be prevented when the aforementioned apparatus main body is lifted up and moved, and therefore, the problem caused by spray of the agent to legs and hands, clothing and the like can be reliably prevented.

Further, in the spray apparatus of the fifth aspect of the present invention, it can be detected that the apparatus main body falls down by the bottom surface switch provided in the apparatus main body.

Therefore, as compared with the case of using an expensive inclination sensor which detects the inclination of the apparatus main body, a measurement sensor which measures a separation distance from the mounting surface, or the like, the cost can be reduced and the configuration can be simplified.

Further, in the spray apparatus of the sixth aspect of the present invention, by pressing down and operating the push-button type spray switch which is provided in the top part of the aforementioned apparatus main body, the aforementioned agent can be arbitrarily sprayed. Thereby, the use mode can be enlarged, and the convenience is enhanced.

At this time, the aforementioned apparatus main body is formed to be a laterally oriented shape in plane view, and the aforementioned bottom surface switch and the aforementioned spray switch are disposed at one side with the center in the lateral direction of the apparatus main body as the boundary. Therefore, in the state in which the spray switch provided in the top part of the aforementioned apparatus main body is pressed down and operated, an unexpected lift can be prevented at the aforementioned on side of the aforementioned bottom surface provided with the aforementioned bottom surface switch.

Thereby, an unexpected operation of the aforementioned bottom surface switch at the time of pressing down the aforementioned spray switch can be prevented, as compared with the case in which the aforementioned one side of the aforementioned bottom surface provided with the aforementioned bottom surface switch lifts up when the aforementioned spray switch is pressed down and operated. Thereby, an unexpected operation of the spray prevention function of the aforementioned agent due to the state change of the bottom surface switch can be prevented.

DETAILED DESCRIPTION OF THE INVENTION

Hereinafter, one embodiment of the present invention will be described in accordance with the drawings.

Figure 1:
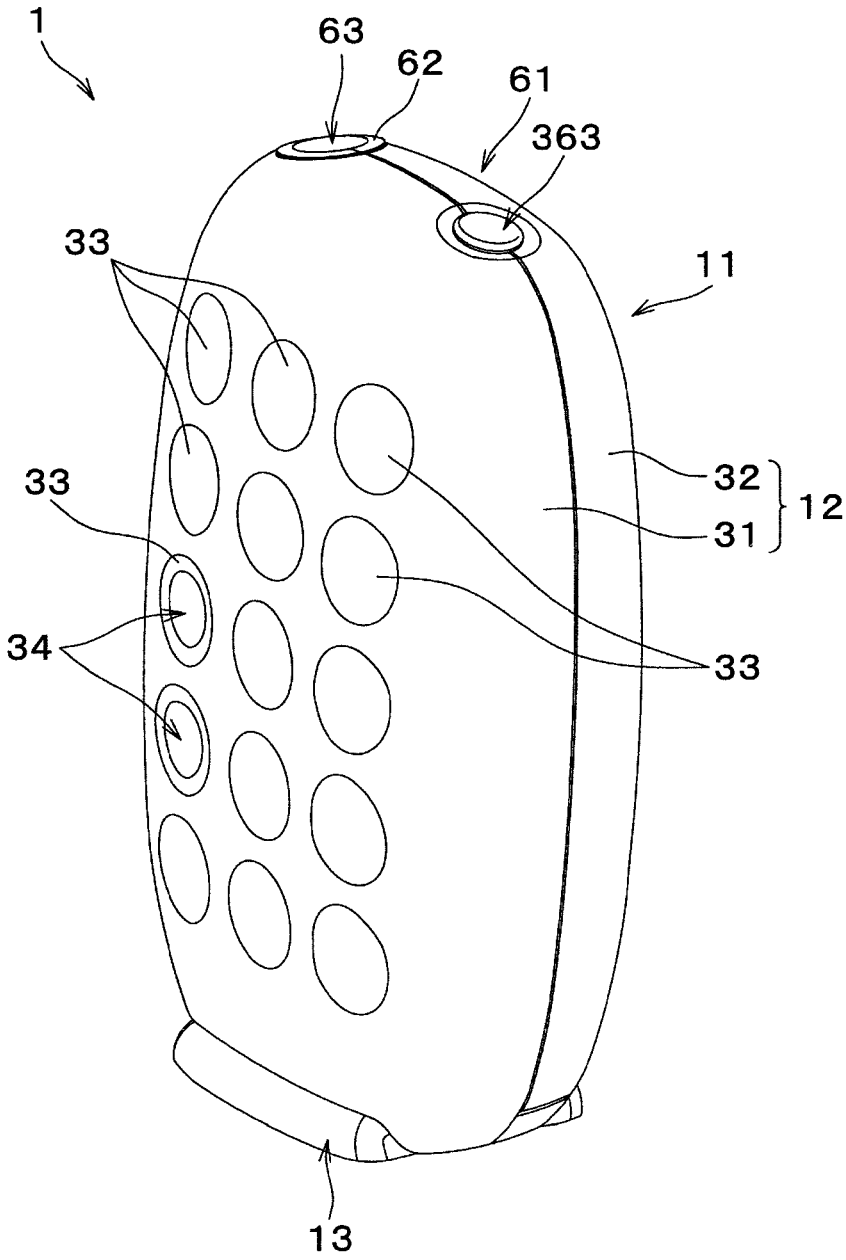
FIG. 1 is a perspective view showing one embodiment of the present invention.

FIG. 1 is a view showing a spray apparatus 1 according to the present embodiment, and the spray apparatus 1 is an apparatus which automatically sprays an agent such as an aromatic, a deodorant, an insect repellent or an insecticide.

In a spray can (aerosol), compressed gas such as nitrogen and liquefied gas such as LPG are mixed as a spray agent in addition to the agent, and the aforementioned agent is configured to be able to be sprayed by the spray agent.

Figure 2:
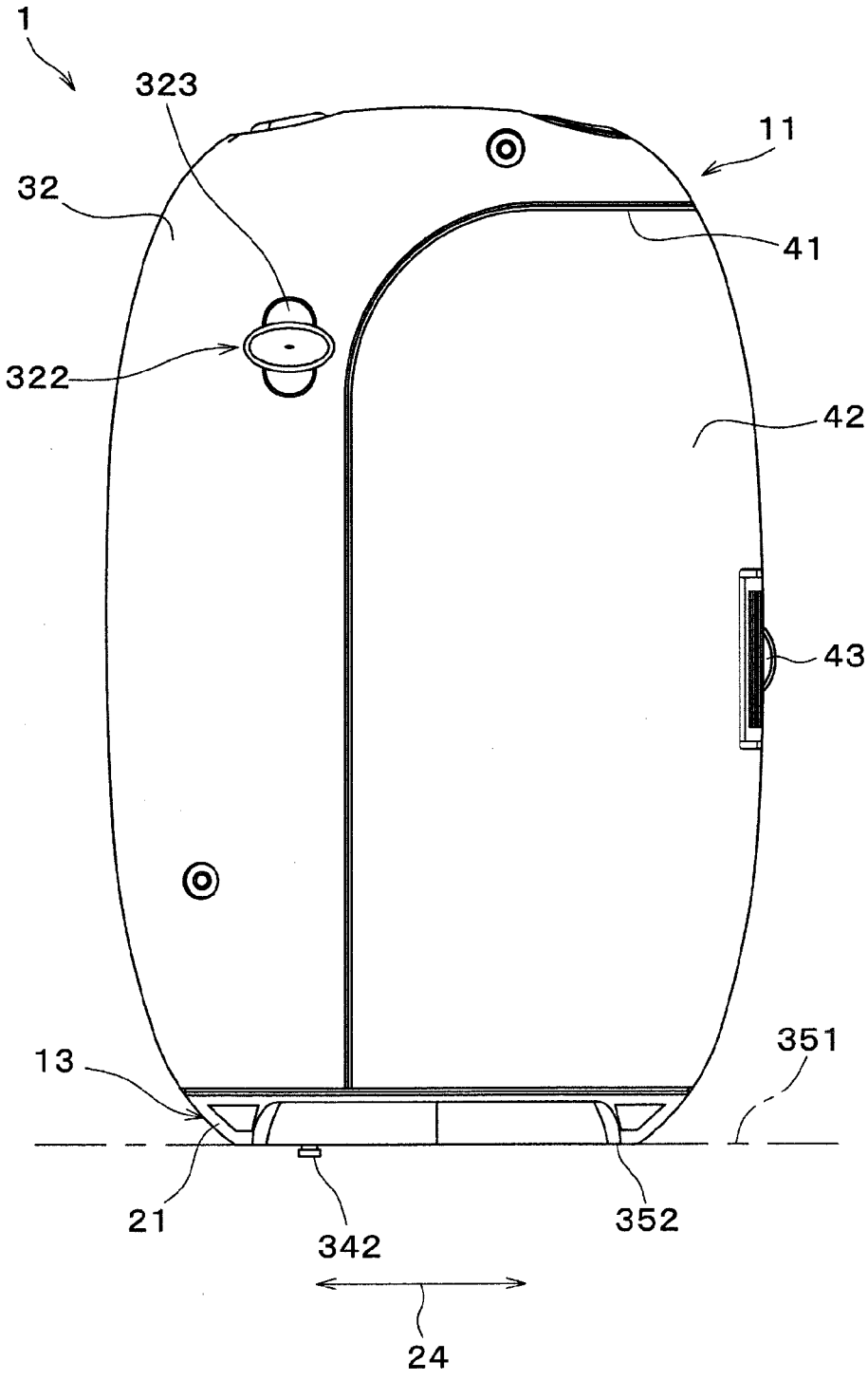
FIG. 2 is a rear view showing the same embodiment.
Figure 3:
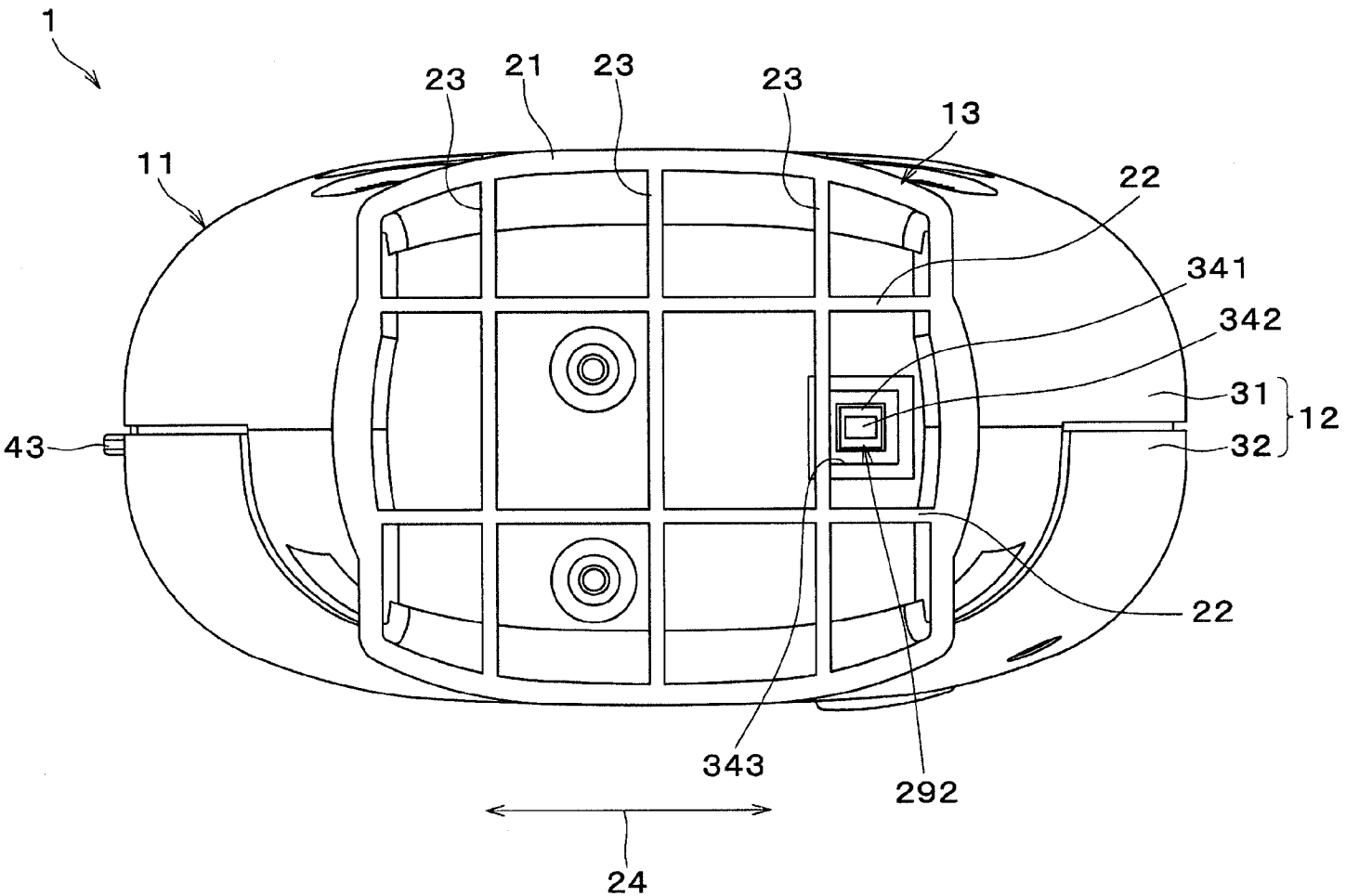
FIG. 3 is a bottom view showing the same embodiment.

A case 12 forming an apparatus main body 11 of the spray apparatus 1 is formed into a vertically oriented rectangle, and has corner portions rounded, as shown in FIGS. 1 and 2. The case 12 is formed into a laterally oriented shape in plane view, and a leg part 13 in a laterally oriented rectangle is provided at a lower part of the case 12, as shown in FIGS. 1 and 3.

A peripheral edge rib 21 extending to a lower side is integrally formed at a peripheral edge of the leg part 13, and lateral ribs 22 and 22 extending in the lateral direction of the apparatus main body 11 are provided at two locations inside the peripheral edge rib 21. Further, vertical ribs 23 extending in the longitudinal direction of the apparatus main body 11 are provided at three locations inside the aforementioned peripheral edge rib 21, and the vertical rib 23 located in the center is provided in the center in a lateral direction 24 of the apparatus main body 11.

As shown in FIG. 1, the aforementioned case 12 is formed by a front case 31 configuring a front surface, and a rear case 32 configuring a rear surface, and the aforementioned leg part 13 is integrally formed at the lower end portion of the aforementioned front case 31. In the front case 31, circular recessed portions 33 are laterally and vertically formed, and sight holes 34 and 34 are provided in some of them. The sight holes 34 and 34 communicate with an inside, and are configured so that presence or absence of the spray can housed in the case 12 and the kind of the spray can is able to be confirmed from the outside.

The aforementioned rear case 32 has a right side in the drawing cut out as shown in FIG. 2, and a replacement port 41 for replacing the spray can is formed. The replacement port 41 is closed to be openable and closable by a lid body 42, and an operation claw 43 to be operated at the time of opening is projectingly provided at a side portion of the lid body 42.

Figure 4:
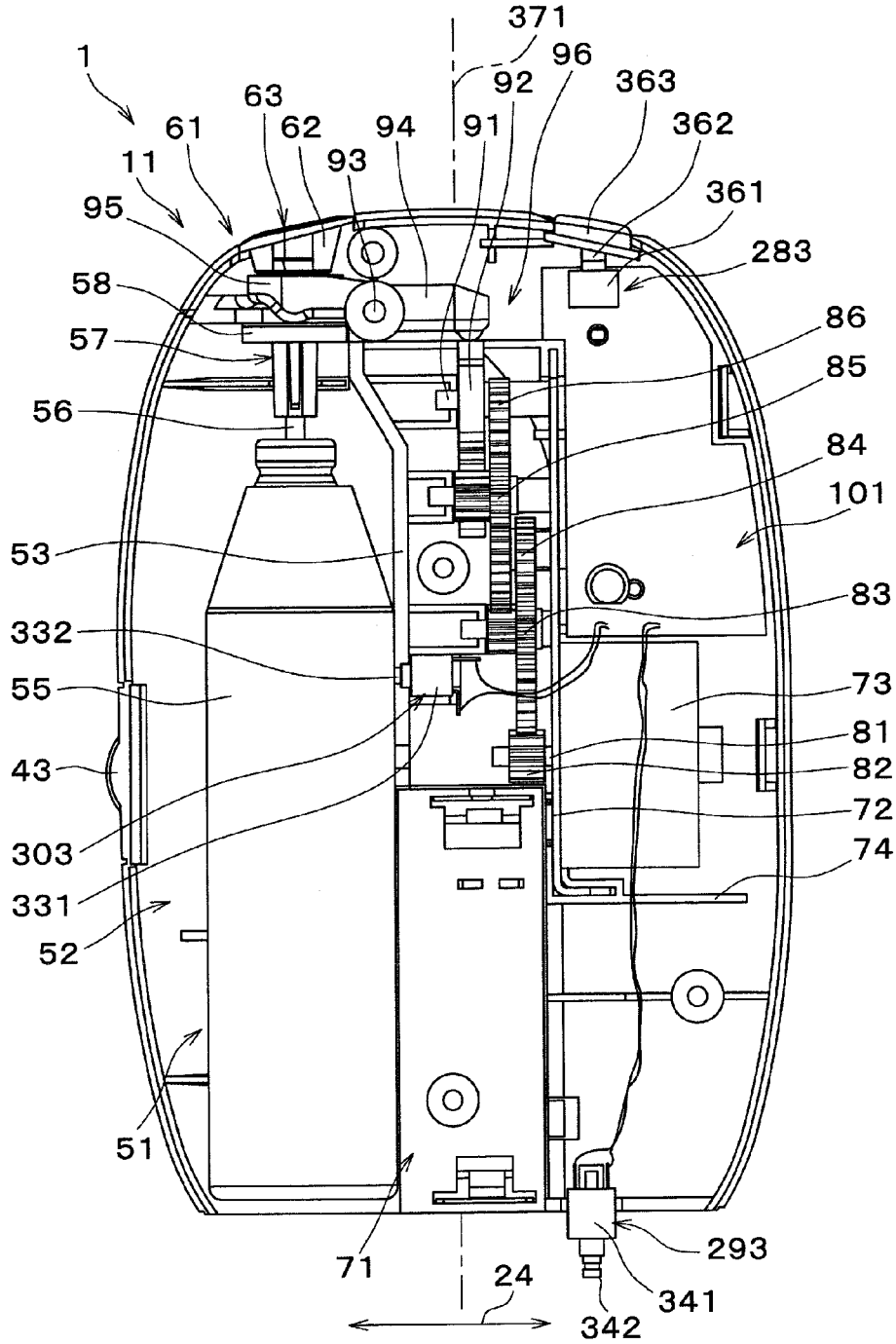
FIG. 4 is an explanatory view showing an inside of the same embodiment.

FIG. 4 is a view showing an inside of the aforementioned apparatus main body 11, and shows the state in which the aforementioned front case 31 is removed.

At a left side in FIG. 4 of this apparatus main body 11, a housing space 52 which houses a spray can 51 is defined and formed by a partition 53. The spray can 51 is configured by a can main body 55 which houses the aforementioned agent, and a cylindrical nozzle 56 which extended from the can main body 55. A spray adapter 57 is provided at a tip end portion of the nozzle 56, and a disc-shaped flange portion 58 which is extended sideward is integrally formed at the upper portion of the spray adapter 57.

A spray nozzle part extended from the aforementioned spray adapter 57 is configured to project into a spray port 63 of a cylindrical member 62 fitted to a top part 61 of the aforementioned case 12 (see FIG. 1), and is configured to be able to spray the agent from the aforementioned spray can 51 directly above through the aforementioned spray port 63.

In the aforementioned spray can 51, the valve which controls spray of the agent is configured by a metering valve. The metering valve is configured to spray a constant amount of agent by one push operation of the nozzle 56.

Thereby, the spray can is configured so that a constant amount of agent can be sprayed irrespective of the rotational speed of a drive motor 73, even if the output voltage of the dry battery in use drops, and the rotational speed of the drive motor 73 which will be described later decreases.

In the present embodiment, the case of using the spray can 51 containing the aforementioned metering valve is described, but the present embodiment is not limited to this, and the spray can 51 having an ordinary valve, which sprays an agent while the nozzle 56 is being pressed, may be used.

In this case, the opening time of the valve can be controlled by the rotational speed of a cam 92 which will be described later by the aforementioned drive motor 73, and when the pressing force of the aforementioned nozzle 56 via a lever 94 which will be described later by the aforementioned cam 92 is released, the aforementioned lever 94 is pushed back by the spring in the aforementioned valve to close the aforementioned valve, and spray can be stopped, so that intermittent spray is enabled.

At the right side in FIG. 4 of the aforementioned housing space 52, a battery housing part 71 which houses a dry battery is provided at a lower portion, and a vertical wall 72 is provided at the right side in FIG. 4 of the battery housing part 71. At the right side in FIG. 4 from the vertical wall 72, the drive motor 73 which operates by receiving power supply from the aforementioned dry battery is provided. The drive motor 73 is fixed in the state supported by a support plate 74.

A drive shaft 81 of the drive motor 73 is inserted through the aforementioned vertical wall 72, and a drive gear 82 is fixed to the drive shaft 81. The drive gear 82 is connected to a first reduction gear 83, and the first reduction gear 83 is connected to a second reduction gear 84. The second reduction gear 84 is connected to a third reduction gear 85. The third reduction gear 85 is connected to a fourth reduction gear 86, and the aforementioned respective reduction gears 83 to 86 are rotatably supported between the aforementioned partition 53 and the aforementioned vertical wall 72.

A cam 92 is provided at a support shaft 91 of the aforementioned fourth reduction gear 86, and the cam 92 is configured to slide in contact with one end of a lever 94 which is supported by a rotating shaft 93. A plate-shaped working part 95 is formed at the other end portion of the lever 94, and an insertion hole through which the aforementioned spray nozzle part extended from the aforementioned spray adapter 57 inserts is provided in the working part 95 (not illustrated).

Thereby, the aforementioned respective reduction gears 83 to 86 and the aforementioned cam 92 are rotated by the aforementioned drive motor 73, and one end portion of the aforementioned lever 94 is moved upward with the aforementioned cam 92, whereby the aforementioned working part 95 provided at the other end portion of the lever 94 is configured to be tiltable downward, and a spray mechanism 96 is configured, which sprays the aforementioned agent from the aforementioned spray can 51 by pressing the aforementioned spray adapter 57 which is inserted through the aforementioned insertion hole of the working part 95 by the aforementioned flange portion 58 with downward tilting movement of the working part 95.

A control board 101 is provided at a right side of the spray mechanism 96, and an electric circuit is configured in the control board 101.

Figure 5:
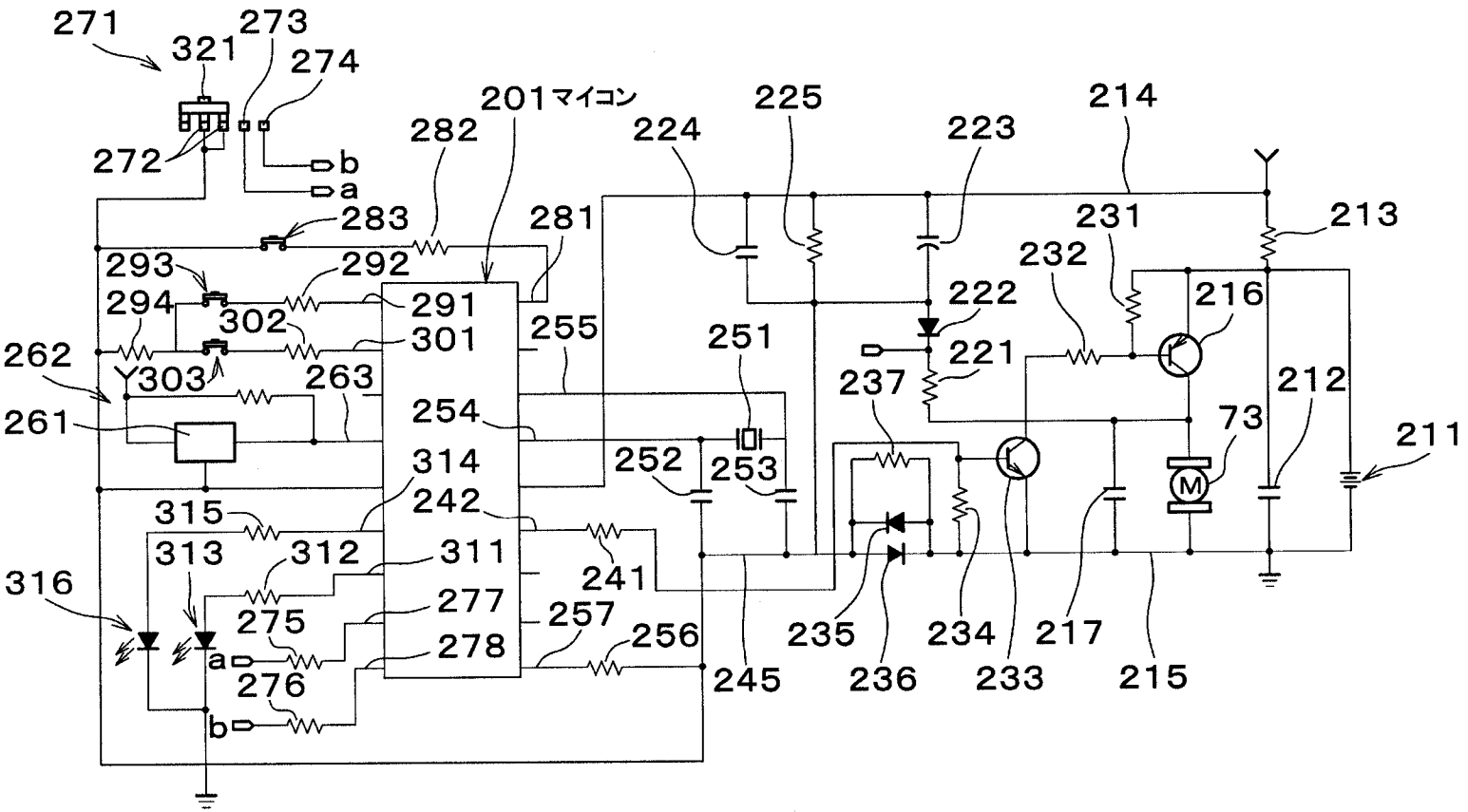
FIG. 5 is a circuit diagram showing a control circuit of the same embodiment.

FIG. 5 is a circuit diagram showing the electric circuit, and the electric circuit is configured with a micon (microcomputer) 201 containing a ROM and a RAM as a core.

More specifically, a capacitor 212 is connected in parallel with a power supply 211 configured by a dry battery of the aforementioned battery housing part 71, and a power supply line 214 for microcomputer connected to the aforementioned microcomputer 201 through a resistor 213 is connected to a positive terminal of the aforementioned power supply 211. A current-carrying circuit configured by a PNP transistor 216 and the aforementioned drive motor 73 is connected to between the positive terminal of the aforementioned power supply 211 and a ground line 215 connected to a negative terminal of the aforementioned power supply 211, and a capacitor 217 is connected in parallel to the drive motor 73.

A resistor 221 and a diode 222 are connected in series to a positive terminal of the aforementioned drive motor 73, and the aforementioned power supply line 214 for microcomputer is connected to an anode of the diode 222 via a parallel circuit configured by a pair of capacitors 223 and 224 and a resistor 225.

A resistor 231 is provided between an emitter and a base of the aforementioned PNP transistor 216, and a collector of an NPN transistor 233 is connected to the base through a resistor 232. An emitter of the NPN transistor 233 is connected to the aforementioned ground line 215, and a resistor 234 is connected to between the base and the emitter.

An output port 242 of the aforementioned microcomputer 201 is connected to a base of the NPN transistor 233 through a resistor 241, and the aforementioned NPN transistor 233 is operated to be turned on by producing a high output from the output port 242, whereby the aforementioned PNP transistor 216 is operated to be turned on to supply electric power from the aforementioned power supply 211 to the aforementioned drive motor 73. Meanwhile, the aforementioned NPN transistor 233 is operated to be turned off by producing a low output from the aforementioned output port 242, whereby the aforementioned PNP transistor 216 is operated to be turned off so that the power supply to the aforementioned drive motor 73 can be cut off.

In the aforementioned ground line 215, a ground line 245 for microcomputer connected to the aforementioned microcomputer 201 is formed by a parallel circuit in which a pair of diodes 235 and 236, which are provided in parallel in the opposite orientations, and a resistor 237 are connected in parallel, and the anode of the aforementioned diode 222 connected to the aforementioned drive motor 73 is connected to the ground line 245 for microcomputer.

An oscillating circuit configured by a crystal oscillator 251 and a pair of capacitors 252 and 253 is connected to the aforementioned ground line 245 for microcomputer, and the aforementioned crystal oscillator 251 configuring the oscillating circuit is connected to ports 254 and 255 of the aforementioned microcomputer 201. Further, the aforementioned ground line 245 for microcomputer is connected to a port 257 of the aforementioned microcomputer 201 via a resistor 256.

A watchdog circuit 262 including a watch dog IC 261 is connected to the microcomputer 201, so that the output from the watchdog circuit 262 is configured to be inputted into an input port 263 of the aforementioned microcomputer 201.

Common terminals 272 and 272 of a slide switch 271 are connected to the aforementioned microcomputer side ground line 245, and a first terminal 273 and a second terminal 274 of the slide switch 271 are connected to input ports 277 and 278 of the aforementioned microcomputer 201 via resistors 275 and 276.

A turbo switch 283 as a push-button type spray switch is connected to an input port 281 of the microcomputer 201 via a resistor 282, and the turbo switch 283 is connected to the aforementioned microcomputer side ground line 245.

Further, a stand switch 293 as a bottom surface switch is connected to an input port 291 of the aforementioned microcomputer 201 via a resistor 292, and the stand switch 293 is connected to the aforementioned microcomputer side ground line 245 via a resistor 294.

Further, a bottle switch 303 is connected to another input port 301 via a resistor 302, and the bottle switch 303 is connected to the aforementioned microcomputer side ground line 245 via the aforementioned resistor 294.

A green light-emitting diode 313 is connected to an output port 311 of the aforementioned microcomputer 201 via a resistor 312, and the green light-emitting diode 313 is connected to a negative terminal of the aforementioned power supply 211. Further, an amber-colored light-emitting diode 316 is connected to another output port 314 of the aforementioned microcomputer 201 via a resistor 315, and the amber-colored light-emitting diode 316 is also connected to the negative terminal of the aforementioned power supply 211.

An operation part 321 of the aforementioned slide switch 271 is provided with an operation lever 322 in a laterally oriented elliptical shape, and the operation lever 322 is projected outside the rear case 32 via a slide groove 323 provided in the aforementioned rear case 32, as shown in FIG. 2. Thereby, the slide switch is configured to be able to form a first slide state in which the aforementioned common terminals 272 and 272 of the aforementioned slide switch 322 are not connected to the other terminals 273 and 274, a second slide state in which the aforementioned common terminals 272 and 272 are connected to the aforementioned first terminal 273, and a third slide state in which the aforementioned common terminals 272 and 272 are connected to the aforementioned first terminal 273 and the aforementioned second terminal 274, by moving the aforementioned operation lever 322 up and down along the aforementioned slide groove 323.

All the ports of the aforementioned microcomputer 201 are assumed to be pulled up with pull-up resistors contained therein.

The aforementioned bottle switch 303 is configured so that its switch main body 331 is fixed to the aforementioned partition 53, and an operation part 332 extended from the switch main body 331 is projected to the aforementioned housing space 52 which houses the aforementioned spray can 51, as shown in FIG. 4. The operation part 332 is set to have such a length as to abut on the side surface of a can main body 55 of the spray can 51 when the aforementioned spray can 51 is fitted in the aforementioned housing space 52, and is configured so that the bottle switch 303 is operated to be turned on when the aforementioned operation part 332 abuts on the side surface of the aforementioned can main body 55 and retreats.

The aforementioned stand switch 293 has its switch main body 341 fixed to a bottom wall surface of the aforementioned rear case 32, and is configured so that an operation part 342 extended from the switch main body 341 projects downward via a rectangular hole 343 provided in the aforementioned leg part 13 as shown in FIG. 3, and projects downward from the respective ribs 21 to 23 configuring the leg part 13 as shown in FIG. 2.

Thereby, the stand switch 293 is configured to operate to be turned off when the apparatus main body 11 mounted on a mounting surface 351 falls down, a bottom surface 352 of the leg part 13 of the apparatus main body 11 moves away from the aforementioned mounting surface 351, and the aforementioned operation part 342 of the aforementioned stand switch 293 is extended so that the fall of the aforementioned apparatus main body 11 is configured to be detectable from the operating state of the stand switch 293.

The aforementioned turbo switch 283 is provided at the aforementioned control board 101 as shown in FIG. 4, and an operation part 362 extended from a switch main body 361 is provided with a circular turbo button 363. The turbo button 363 is configured to project from the aforementioned top part 61 of the aforementioned case 12, and the aforementioned turbo button 363 projected from the top part 61 is configured to be able to operate the aforementioned turbo switch 283 to be turned on by being pressed downward and retreated.

The turbo button 363 of the turbo switch 283 is provided at a right side in FIG. 4 with a center line 371 which is the center in the lateral direction 24 of the aforementioned apparatus main body 11 as a boundary, and the aforementioned stand switch 293 is also provided at the right side in FIG. 4 with the aforementioned center line 371 as the boundary. Thereby, both the aforementioned stand switch 293 configuring the bottom surface switch and the aforementioned turbo switch 283 configuring the spray switch are disposed at one side with the center in the lateral direction 24 of the aforementioned apparatus main body 11 as the boundary, and the aforementioned turbo switch 283 is provided substantially right above the aforementioned stand switch 293.

The spray apparatus 1 is configured so that the aforementioned microcomputer 201 operates in accordance with the program stored in the contained ROM, and thereby, regularly operates the aforementioned spray mechanism 96 to spray the aforementioned agent automatically from the aforementioned spray can 51 which is set in the apparatus main body 11, and is configured to avoid the spray process of the aforementioned agent when detecting a fall of the apparatus main body 11.

Further, the spray apparatus is configured so that when the aforementioned turbo button 363 provided in the aforementioned top part 61 of the aforementioned apparatus main body 11 is depressed, and the aforementioned turbo switch 283 is operated to be turned on, the aforementioned spray mechanism 96 is operated to forcefully execute the aforementioned spray process of spraying the aforementioned agent from the aforementioned spray can 51.

Figure 6:
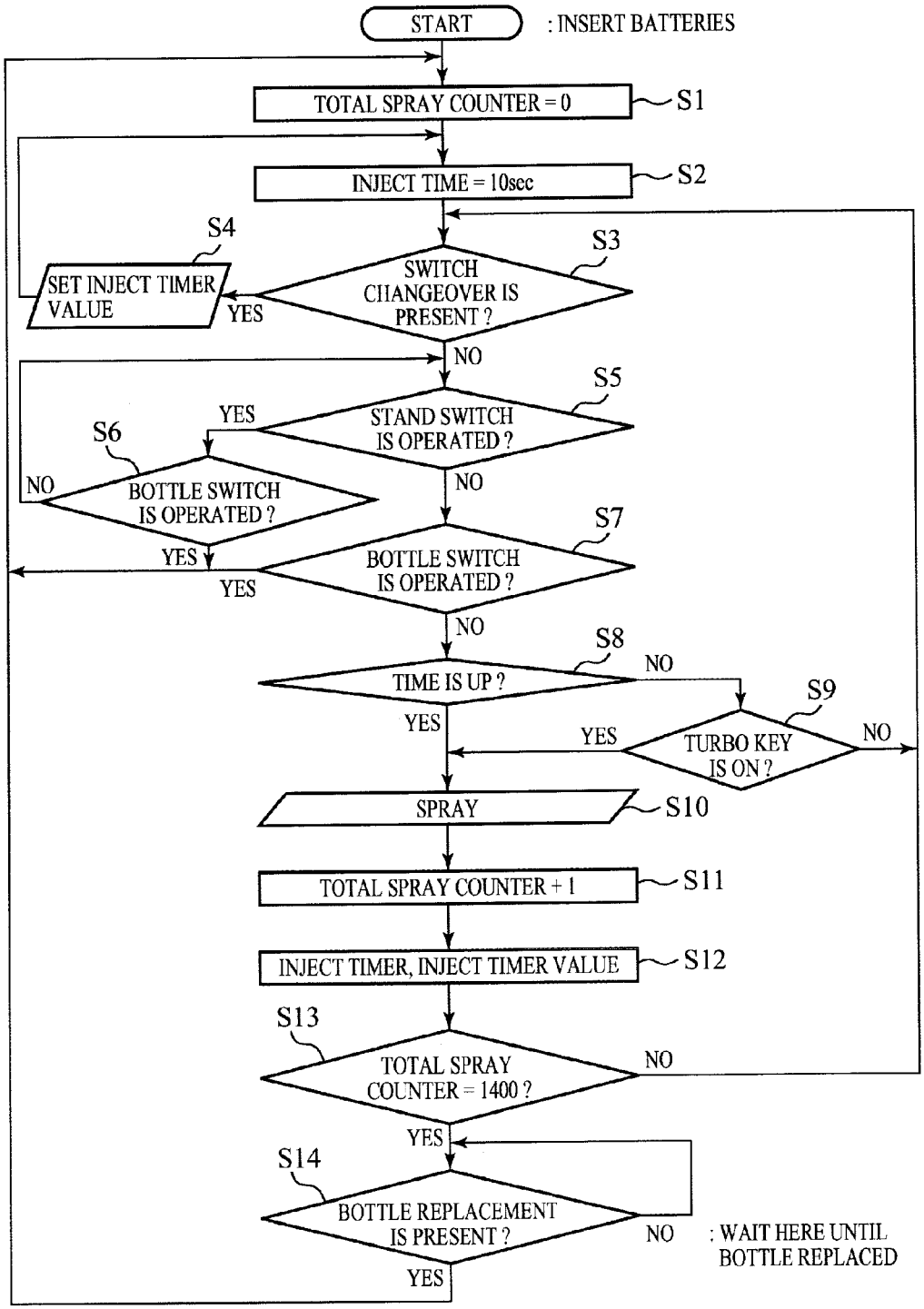
FIG. 6 is a flowchart showing an operation of the same embodiment.

The operation of the present embodiment according to the above configuration will be described in accordance with a flowchart shown in FIG. 6.

More specifically, when a dry battery is set in the battery housing part 71 of the aforementioned apparatus main body 11, and the aforementioned microcomputer 201 is operated and starts an operation in accordance with the program stored in the ROM, a total spray counter secured in the RAM contained therein is cleared to "0" (S1), and the value for counting 10 seconds is set to an eject timer counted down at each predetermined time (S2), after which, it is determined whether or not switching of the switch takes place from the presence or absence of the state change of the input ports 277 and 278 to which the aforementioned slide switch 271 is connected (S3).

At this time, at the initial stage when the power is inputted, the input changes as a result of the fixed value of "L" or "H" is inputted to the aforementioned respective input ports 277 and 278, and therefore, it is determined that switching of the switch takes place, and the slide state of the aforementioned slide switch 271 is detected by the inputs from the aforementioned respective input ports 277 and 278, the stored value corresponding to the slide state is selected from the timer values stored in the aforementioned ROM in advance, and is set to the eject timer value secured in the aforementioned RAM (S4). Subsequently, the flow returns to the aforementioned step S1.

Describing more concretely, when the aforementioned slide switch 271 is in the first slide state, the first timer value is read out from the aforementioned ROM and 30 minutes indicated by the first timer value is set to the aforementioned eject timer value. When the aforementioned slide switch 271 is in the second slide state, the second timer value is read out from the aforementioned ROM, and 45 minutes indicated by the second timer value is set to the aforementioned eject timer value. Further, when the aforementioned slide switch 271 is in the third slide state, the third timer value is read out from the aforementioned ROM, and 60 minutes indicated by the third timer value is set to the aforementioned eject timer value.

Subsequently, 10 seconds is set to the aforementioned eject timer (S2), the present states of the aforementioned respective input ports 277 and 278 are compared with the states of the respective input ports 277 and 278 of the previous time, and it is determined whether or not switching of the aforementioned slide switch 271 is performed (S3). If the aforementioned slide switch 271 is not switched, it is determined whether or not the aforementioned stand switch 293 is operated (S5).

At this time, in the normal state in which the bottom surface 352 of the leg part 13 of the aforementioned apparatus main body 11 is in contact with the mounting surface 351, and the operation part 342 of the aforementioned stand switch 293 is pushed by the aforementioned mounting surface 351 and is retreated, the aforementioned stand switch 293 is on, and the input port 291 of the microcomputer 201 to which the stand switch 293 is connected is kept "L", whereas when the apparatus main body 11 falls down, the bottom surface 352 of the leg part 13 of the apparatus main body 11 separates from the mounting surface 351 and the operation part 342 of the aforementioned stand switch 293 is extended, the stand switch 293 is operated to be turned off, and the aforementioned input port 291 changes to "H" from "L".

Therefore, when the aforementioned stand switch 293 is operated to be turned off, and the input port 291 of the microcomputer 201 changes to "H" from "L", it can be detected that the apparatus main body 11 falls down based on the off operation of the aforementioned stand switch 293, and therefore, the flow branches to step S6.

In step S6, it is determined whether or not the aforementioned bottle switch 303 is operated to be turned on (S6).

Here, when the spray can 51 is set in the housing space 52 of the aforementioned apparatus main body 11, and the can main body 55 of the spray can 51 presses the operation part 332 of the aforementioned bottle switch 303 and is retreated, the aforementioned bottle switch 303 is configured to be turned on so that the input port 301 of the aforementioned microcomputer 201 becomes "L". When the spray can 51 is not set in the aforementioned housing space 52, and the operation part 332 of the aforementioned bottle switch 303 is extended to the aforementioned housing space 52 side, the aforementioned bottle switch 303 is configured to be turned off so that the aforementioned input port 301 becomes "H". Thereby, the set state of the aforementioned spray can 51 in the aforementioned housing space 52 is configured to be detectable.

Therefore, when the aforementioned input port 301 is "H", and the aforementioned spray can 51 is not set in the aforementioned housing space 52, the flow branches to the aforementioned step S1 and returns to the initial state, whereas when the aforementioned input port 301 is "L", and the aforementioned spray can 51 is set in the aforementioned housing space 52, the flow shifts to the aforementioned step S5, and until the apparatus main body 11 which falls down is raised, and the aforementioned stand switch 303 operates, the flow enters the loop of steps S5 and S6.

Meanwhile, when in the aforementioned step S5, the aforementioned input port 291 is "L", and it can be confirmed that the apparatus main body 11 stands upright on the aforementioned mounting surface 351, it is determined whether or not the aforementioned bottle switch 303 is operated to be turned on (S7).

At this time, if the aforementioned input port 301 is "H", and the aforementioned spray can 51 is not set in the aforementioned housing space 52, the flow branches to the aforementioned step S1 and returns to the initial state, whereas if the aforementioned input port 301 is "L" and the aforementioned spray can 51 is set in the aforementioned housing space 52, the flow shifts to the next step S8.

In this step S8, it is determined whether or not the aforementioned eject time during countdown becomes "0" and the time is up (S8), and when the time is up, the flow shifts to step S10, whereas when the time is not up, the flow branches to step S9, and it is determined whether or not the turbo button 363 of the top part 61 of the aforementioned apparatus main body 11 is pressed (S9).

At this time, in the off state of the aforementioned turbo switch 283 in which the turbo button 363 in the top part 61 of the aforementioned apparatus main body 11 is not pressed, and the operation part 362 of the aforementioned turbo switch 283 is extended, the input port 281 of the aforementioned microcomputer 201 becomes "H", whereas when the aforementioned turbo button 363 is pressed down, the operation part 362 of the aforementioned turbo switch 283 retreats and the turbo switch 283 is operated to be turned on, the input port 281 of the aforementioned microcomputer 201 changes to "L" from "H".

Therefore, when the aforementioned input port 281 is "L", and the aforementioned turbo switch 283 is operated, the flow shifts to the aforementioned step S10 and the spray process is performed, whereas when the aforementioned input port 281 is "H" and the aforementioned turbo switch 283 is not operated, the flow branches to the aforementioned step S3 and the aforementioned respective steps are repeated until the aforementioned eject time which is being counted down is up.

In the aforementioned step S10, "H" is outputted from the output port 242 of the aforementioned microcomputer 201 for a predetermined time which is set in advance, and the NPN transistor 233 and the PNP transistor 216 are operated to be turned on, whereby, the power from the aforementioned power supply 211 is supplied to the aforementioned drive motor 73. Subsequently, the drive motor 73 rotates the cam 92 via the aforementioned respective reduction gears 83 to 86 of the spray mechanism 96, and the lever 94 supported by the rotating shaft 93 is tilted by the cam 92, whereby the spray adapter 57 of the spray can 51 is pressed downward, and the agent is sprayed from the spray can 51 (S10).

Subsequently, "1" is added to the aforementioned total spray counter secured in the aforementioned RAM (S11), the aforementioned timer value stored in the aforementioned eject timer value based on the slide state of the aforementioned slide switch 271 is set again to the aforementioned eject time (S12), after which, it is determined whether or not the aforementioned total spray counter reaches "1400" (S13).

Since at the initial stage, the aforementioned total spray counter does not reach "1400", the flow shifts to the aforementioned step S3 and spray of the agent is repeated at each time indicated by the aforementioned timer value, whereas when the aforementioned total spray counter reaches "1400" and spray of the aforementioned agent is performed 1400 times, it is determined whether or not the spray can 51 set in the aforementioned housing space 52 is replaced, from the presence or absence of the state change of the aforementioned bottle switch 303 (S14). After the flow waits until the spray can 51 is replaced, and when the spray can 51 is replaced, the flow branches to the aforementioned step S1 and returns to the initial state.

Like this, when the apparatus main body 11 falls down while the apparatus main body 11 in which the aforementioned spray can 51 is set is mounted on the mounting surface 351 and used, it can be detected that the aforementioned apparatus main body 11 falls down in step S5 of determining the state of the aforementioned stand switch 293, and when a fall of the apparatus main body 11 is detected, the flow branches to the aforementioned step S6 and enters a loop, whereby, a shift to the spray process of the aforementioned step S10 of spraying the agent from the aforementioned spray can 51 can be avoided.

As a result, if the aforementioned apparatus main body 11 falls down, spray of the agent from the aforementioned spray can 51 can be prevented.

Therefore, even if the spray apparatus 1 falls down, spray of the agent in an unintended direction can be prevented, as compared with the conventional spray apparatus which sprays an agent when the spray requirements such as a lapse of a predetermined time, and operation of the spray switch are fulfilled.

Thereby, for example, even if the apparatus main body 11 falls down with the spray port 63 of the top part 61 facing the wall surface, the trouble which can occur at the time of falling that the agent is sprayed to the wall surface and contaminates the wall surface can be reliably prevented.

When the apparatus main body 11 is lifted up and transferred, spray of the aforementioned agent can be prevented, and therefore, the troubles due to spray of the agent to hands and legs, clothes and the like can be reliably prevented.

Even if the aforementioned turbo button 363 is mistakenly pushed during the transfer, by entering the loop of the aforementioned steps S5 and S6, spray of the aforementioned agent can be prevented, and therefore, the trouble due to spray of the agent by a malfunction during the transfer can be avoided.

Further, the aforementioned apparatus main body 11 is provided with the stand switch 293 as the bottom surface switch which operates when the bottom surface 352 of the leg part 13 of the apparatus main body 11 separates from the mounting surface 351, and a fall of the aforementioned apparatus main body 11 can be detected from the operation state of the stand switch 293.

Therefore, as compared with the case of using an expensive inclination sensor which detects the inclination of the aforementioned apparatus main body 11, a measurement sensor which measures a separation distance from the aforementioned mounting surface 351 and detects separation from the mounting surface 351 and the like, cost can be reduced, and the configuration can be simplified.

Meanwhile, the top part 61 of the aforementioned apparatus main body 11 is provided with the turbo switch 283 as a push-button type spray switch, and by operating the turbo switch 283 by depressing the turbo button 363 of the turbo switch 283, in the aforementioned step S9, the flow is forcefully branched to the spray process of the aforementioned step S10, and the aforementioned spray process is executed, so that the aforementioned agent can be sprayed.

Therefore, as compared with the case in which the apparatus has to wait for spray of the agent until the next spray time comes, the use mode can be enlarged, and the convenience is enhanced.

At this time, the aforementioned apparatus main body 11 is formed in a laterally oriented shape in plane view, and at the right side in FIG. 4 with the center in the lateral direction of the apparatus main body 11 as the boundary, the aforementioned stand switch 293 as the aforementioned bottom surface switch and the aforementioned turbo switch 283 which is the aforementioned spray switch are disposed. Therefore, in the state in which the turbo button 363 of the aforementioned turbo switch 283 provided in the top part 61 of the aforementioned apparatus main body 11 is operated by being depressed, an accidental lift at the right side in FIG. 4 of the bottom surface 352 of the aforementioned leg part 13 where the aforementioned stand switch 293 is provided can be prevented.

As a result, as compared with the case in which the right side in FIG. 4 of the aforementioned bottom surface 352 where the aforementioned stand switch 293 is provided is lifted when the turbo button 363 of the aforementioned turbo switch 283 is operated by being depressed, an accidental operation of the aforementioned stand switch 293 at the time of depressing the aforementioned turbo button 363 can be prevented.

Thereby, an accidental operation of the spray preventing function of the aforementioned agent due to the state change of the stand switch 293 can be prevented.

In the present embodiment, only the case of detecting a fall of the apparatus main body 11 by the aforementioned stand switch 293 is described, but the present invention is not limited to this.

For example, the present invention may be configured by using, for example, an inclination sensor which detects the inclination of the aforementioned apparatus main body 11, a measurement sensor which measures a separation distance from the aforementioned mounting surface 351 and detects separation from the mounting surface 351, and the like.

Further, in the present embodiment, the case in which the state of mounting the aforementioned apparatus main body 11 on the aforementioned mounting surface 351 is set as a proper position is described, but the present invention is not limited to this.

For example, the state in which the apparatus main body 11 stands upright along the wall surface of a room, and the state of hanging the apparatus main body 11 on the aforementioned wall surface can be set as the proper positions.

In this case, by providing the switch which operates when the rear surface separates from the opposing surface to which the rear surface being one surface of the aforementioned apparatus main body 11 is opposed, it can be detected that the aforementioned apparatus main body 11 is not installed in the aforementioned proper position from the operation state of the switch.

Further, in the present embodiment, the case is described as an example, in which the spray port 63 from which the aforementioned agent is sprayed is provided to face up in the top part 61 of the apparatus main body 11 and the agent is sprayed to right above, but the present invention is not limited to this.

For example, the spray apparatus 1 which sprays an agent diagonally upward, or sprays the agent forward may be adopted.

The invention claimed is:

1. A spray apparatus which sprays an agent from a spray can set in an apparatus main body, comprising:

a stand switch which detects that the apparatus main body has fallen down into a fallen position from a non-fallen position in which the apparatus main body is abutted against a mounting surface therefor; and a microcomputer operatively connected with the stand switch that controls operation of the spray apparatus so that said spray apparatus repeatedly sprays said agent in accordance with predetermined values provided by a spray control program stored in the microcomputer, and which avoids a spray process of the agent when the stand switch detects a fall, the spray apparatus being electrically operable, said operability being maintained when the apparatus main body is in the fallen position; and a push-button type spray switch provided in a top part of the apparatus main body which executes a spray process when pushed and when the apparatus main body is in a non-fallen position thereof such that said push-button type spray switch is not operable to execute a spray process when said apparatus main body is in the fallen position, wherein the apparatus main body is formed in a laterally oriented shape in plan view, and the stand switch and the push-button spray switch are oppositely disposed relative to each other at one side of the apparatus main body along a longitudinal direction of the apparatus main body such that a downward depression of the push-button type switch toward the stand switch is operable to maintain operability of the spray apparatus to execute a spray process thereof when the apparatus main body is in the non-fallen position and abutted against the mounting surface therefor.

* * * * *